US006325148B1

(12) United States Patent
Trahan et al.

(10) Patent No.: US 6,325,148 B1
(45) Date of Patent: Dec. 4, 2001

(54) TOOLS AND METHODS FOR USE WITH EXPANDABLE TUBULARS

(75) Inventors: Kevin O. Trahan, Spring; David M. Haugen, League City, both of TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/469,692

(22) Filed: Dec. 22, 1999

(51) Int. Cl.[7] ..... E21B 23/01

(52) U.S. Cl. ..... 166/297; 166/376; 166/382; 166/137; 166/207

(58) Field of Search ..... 166/297, 373, 166/376, 382, 383, 134, 137, 195, 206, 207, 215, 217

(56) References Cited

U.S. PATENT DOCUMENTS

| | | | |
|---|---|---|---|
| 988,504 | 4/1911 | Wiet . | |
| 1,301,285 | 4/1919 | Leonard . | |
| 1,880,218 | 10/1932 | Simmons . | |
| 1,981,525 | 11/1934 | Price . | |
| 2,017,451 | 10/1935 | Wickersham . | |
| 2,214,226 | 9/1940 | English . | |
| 2,383,214 | 8/1945 | Prout et al. | 153/82 |
| 2,424,878 | 7/1947 | Crook | 154/82 |
| 2,499,630 | 3/1950 | Clark | 153/81 |
| 2,519,116 | 8/1950 | Crake | 166/10 |
| 2,627,891 | 2/1953 | Clark | 153/82 |
| 2,633,374 | 3/1953 | Boice | 285/118 |
| 3,028,915 | 4/1962 | Jennings | 166/16 |
| 3,039,530 | 6/1962 | Condra | 166/55 |
| 3,167,122 | 1/1965 | Lang | 166/14 |

(List continued on next page.)

FOREIGN PATENT DOCUMENTS

| | | | |
|---|---|---|---|
| 3213464A1 | 10/1983 | (DE) | B23D/45/12 |
| 4133802C1 | 10/1992 | (DE) | F16L/9/12 |
| WO 93/25800 | 12/1993 | (EP) . | |
| 0 952 305 A1 | 4/1998 | (EP) | E21B/43/10 |
| 0 961 007 A2 | 12/1999 | (EP) | E21B/33/10 |
| 730338 | 3/1954 | (GB) . | |
| 792886 | 4/1956 | (GB) . | |
| 997721 | 7/1965 | (GB) . | |
| 1277461 | 6/1972 | (GB) | B21D/39/04 |
| 1448304 | 9/1976 | (GB) | E21B/33/13 |

(List continued on next page.)

OTHER PUBLICATIONS

Metcalfe, P.—"Expandable Slotted Tubes Offer Well Design Benefits", *Petroleum Engineer International*, vol. 69, No. 10 (Oct. 1996), pp. 60–63—XP000684479.

Partial International Search Report, dated Feb. 2, 2001 (PCT/GB00/04160).

*Primary Examiner*—William Neuder
(74) *Attorney, Agent, or Firm*—Moser, Patterson & Sheridan, L.L.P.

(57) ABSTRACT

Methods, apparatus and tools to be used with tubular expansion apparatus. In one aspect of the invention, tools are actuated or operated within a well by selectively expanding the tool wall. To actuate the tool, the tool wall is urged outward past its elastic limits. The expanding wall physically unlocks a locking ring which then unlocks a piston. Thereafter, hydraulic pressure differences are employed to move the piston to operate the downhole tool. In another aspect of the invention, a first piece of casing is joined to a second, larger diameter casing. By expanding the diameter of the first piece of casing into contact with the second piece of casing, the two are joined together. The joint is formed with helical formations in a manner that provides flow paths around the intersection of the two members for the passage of cement or other fluid.

22 Claims, 8 Drawing Sheets

U.S. PATENT DOCUMENTS

| | | | |
|---|---|---|---|
| 3,179,168 | 4/1965 | Vincent | 166/14 |
| 3,186,485 | 6/1965 | Owen | 166/63 |
| 3,191,677 | 6/1965 | Kinley | 166/14 |
| 3,191,680 | 6/1965 | Vincent | 166/46 |
| 3,195,646 | 7/1965 | Brown | 166/208 |
| 3,203,451 | 8/1965 | Vincent | 138/143 |
| 3,203,483 | 8/1965 | Vincent | 166/207 |
| 3,245,471 | 4/1966 | Howard | 166/46 |
| 3,297,092 | 1/1967 | Jennings | 166/207 |
| 3,326,293 | 6/1967 | Skipper | 166/150 |
| 3,353,599 | 11/1967 | Swift | 166/15 |
| 3,354,955 | 11/1967 | Berry | 166/14 |
| 3,477,506 | 11/1969 | Malone | 166/207 |
| 3,489,220 | 1/1970 | Kinley | 166/277 |
| 3,583,200 | 6/1971 | Cvijanovic | 72/393 |
| 3,669,190 | 6/1972 | Sizer et al. | 166/315 |
| 3,689,113 | 9/1972 | Blaschke | 285/90 |
| 3,691,624 | 9/1972 | Kinley | 29/523 |
| 3,712,376 | 1/1973 | Owen et al. | 166/277 |
| 3,746,091 | 7/1973 | Owen et al. | 166/207 |
| 3,776,307 | 12/1973 | Young | 166/125 |
| 3,780,562 | 12/1973 | Kinley | 72/479 |
| 3,785,193 | 1/1974 | Kinley et al. | 72/393 |
| 3,820,370 | 6/1974 | Duffy | 72/75 |
| 3,948,321 | 4/1976 | Owen et al. | 166/277 |
| 3,977,076 | 8/1976 | Vieira et al. | 30/103 |
| 4,319,393 | 3/1982 | Pogonowski | 29/434 |
| 4,349,050 | 9/1982 | Bergstrom et al. | 138/147 |
| 4,359,889 | 11/1982 | Kelly | 72/62 |
| 4,362,324 | 12/1982 | Kelly | 285/119 |
| 4,382,379 | 5/1983 | Kelly | 73/46 |
| 4,387,502 | 6/1983 | Dom | 29/568 |
| 4,407,150 | 10/1983 | Kelly et al. | 72/61 |
| 4,414,739 | 11/1983 | Kelly | 29/727 |
| 4,445,201 | 4/1984 | Pricer | 365/154 |
| 4,450,612 | 5/1984 | Kelly | 72/62 |
| 4,470,280 | 9/1984 | Kelly | 72/61 |
| 4,483,399 | 11/1984 | Colgate | 166/308 |
| 4,487,630 | 12/1984 | Crook et al. | 75/123 B |
| 4,502,308 | 3/1985 | Kelly | 72/58 |
| 4,505,142 | 3/1985 | Kelly | 72/54 |
| 4,505,612 | 3/1985 | Shelly, Jr. | 405/101 |
| 4,567,631 | 2/1986 | Kelly | 29/157.3 C |
| 4,581,617 | 4/1986 | Yoshimoto et al. | 346/108 |
| 4,626,129 | 12/1986 | Kothmann et al. | 405/43 |
| 4,807,704 | 2/1989 | Hsu et al. | 166/313 |
| 4,848,469 | 7/1989 | Baugh et al. | 166/382 |
| 4,866,966 | 9/1989 | Hagan | 72/75 |
| 4,883,121 | 11/1989 | Zwart | 166/217 |
| 4,976,322 | 12/1990 | Abdrakhmanov et al. | 175/57 |
| 4,997,320 | 3/1991 | Hwang | 408/22 |
| 5,014,779 | 5/1991 | Meling et al. | 166/55.7 |
| 5,052,483 | 10/1991 | Hudson | 166/55 |
| 5,052,849 | 10/1991 | Zwart | 403/300 |
| 5,156,209 | 10/1992 | McHardy | 166/324 |
| 5,267,613 | 12/1993 | Zwart et al. | 166/178 |
| 5,271,472 | 12/1993 | Leturno | 175/107 |
| 5,301,760 | 4/1994 | Graham | 175/61 |
| 5,307,879 | 5/1994 | Kent | 166/382 |
| 5,322,127 | 6/1994 | McNair et al. | 166/313 |
| 5,348,095 | 9/1994 | Worrall et al. | 166/380 |
| 5,366,012 | 11/1994 | Lohbeck | 166/277 |
| 5,409,059 | 4/1995 | McHardy | 166/208 |
| 5,472,057 | 12/1995 | Winfree | 175/57 |
| 5,520,255 | 5/1996 | Barr et al. | 175/24 |
| 5,553,679 | 9/1996 | Thorp | 175/73 |
| 5,560,426 | 10/1996 | Trahan et al. | 166/120 |
| 5,636,661 | 6/1997 | Moyes | 137/614.2 |
| 5,667,011 | 9/1997 | Gill et al. | 166/295 |
| 5,706,905 | 1/1998 | Barr | 175/61 |
| 5,785,120 | 7/1998 | Smalley et al. | 166/55 |
| 5,887,668 | 3/1999 | Haugen et al. | 175/79 |
| 5,901,789 | 5/1999 | Donnelly et al. | 166/381 |
| 5,924,745 | 7/1999 | Campbell | 285/90 |
| 5,960,895 | 10/1999 | Chevallier et al. | 175/27 |
| 5,979,571 | 11/1999 | Scott et al. | 175/61 |
| 6,029,748 | 2/2000 | Forsyth et al. | 166/380 |
| 6,070,671 | 6/2000 | Cumming et al. | 166/381 |
| 1457843 | 12/1976 | (GB) | B21D/39/10 |
| 1582392 | 1/1981 | (GB) | B21D/39/10 |
| 2216926A | 10/1989 | (GB) | E21B/7/20 |
| 2 313 860 B | 6/1996 | (GB) | E21B/10/34 |
| 2 320 734 A | 7/1998 | (GB) | E21B/33/127 |
| 2329918A | 4/1999 | (GB) | E21B/43/10 |

FOREIGN PATENT DOCUMENTS

| | | | |
|---|---|---|---|
| WO 92/01139 | 1/1992 | (WO) | E21B/17/08 |
| WO 93/24728 | 12/1993 | (WO) | E21B/17/10 |
| WO 94/25655 | 11/1994 | (WO) | D04C/1/06 |
| WO 97/21901 | 6/1997 | (WO) | E21B/17/08 |
| WO 98/00626 | 1/1998 | (WO) | E21B/43/10 |
| WO 99/02818 | 1/1999 | (WO) | E21B/43/10 |
| WO 99/18328 | 4/1999 | (WO) | E21B/23/01 |
| WO 99/23354 | 5/1999 | (WO) | E21B/43/10 |

TOOLS AND METHODS FOR USE WITH EXPANDABLE TUBULARS

BACKGROUND OF THE INVENTION

1. Field of the Invention

The present invention relates to expanding tubulars in a well and more particularly, to methods and tools utilizing technology directed towards downhole expansion of tubulars.

2. Background of the Related Art

There are many types of operations that must be performed at some depth in a well and various tools and methods have been developed to perform these downhole operations. Downhole tools for example, are available with means for setting after being placed at some depth in a well. The tools are actuated in order to fix or set them in place in the well. In some cases, setting involves the setting of a slip to secure the position of the tool against the casing walls. For example, with casing liner, one string of casing is hung in the well at the end of a previous string and the liner must be set at the appropriate depth by actuating slips against the inner wall of the existing casing. In another example, a packer used to isolate an annular area between two tubular members, is set at a particular depth in a well prior to expanding its surfaces against the inner tube and the outer tube walls.

There are numerous known ways to set downhole tools. Typically, pressure build up inside or outside the tool is required. In some prior art tools, that pressure is typically communicated through a wall of the tool into a sealed chamber. An actuating piston forms part of the sealed chamber such that the cavity will grow or shrink in volume as the piston moves responsive to the increase or decrease of hydraulic pressure within the tool. These variable-volume cavities outside the wall of the tool are sealed off with eleastomeric O-rings or similar seals. The seals are subject to wear from contamination in wellbore fluids, stroking back and forth in normal operation, and/or temperature or chemical effects from the wellbore fluids. The biggest concern about seal wear is that an open channel could be created through the lateral port in the wall of the tool from inside to outside of the tool, thus upsetting well operations and costing critically expensive downtime for the well operator.

A more recent advance, described in U.S. Pat. No. 5,560,426 employs the principles of pressure differential but without fluid communication throughout he wall of the tool. Instead, the applied pressure differential creates a stress which allows the wall of the tool to flex and fracture a locking ring on the outside surface of the tool. When the ring fractures, a piston moves in reaction to the pressure differential and a spring loaded slip is driven onto a cone, thereby setting the tool in the well. While this technology is an improvement over those requiring an aperture in the tool wall, the structure and mechanical operations required are complicated and subject to failure. For example, in the apparatus described in U.S. Pat. No. 5,560,426, an atmospheric chamber is formed on the inside of the tool body as well as the outside. To begin the tool setting sequence, the outer chamber must be opened to the pressure of the well. Opening the outer chamber is performed by dropping a ball into a seat formed at the top of the chamber and then increasing pressure inside of the tubing and body until the ball, seat and chamber are blown down into the well bore. Assuming that the interior chamber is successfully opened to well pressure, the design also requires a flexing of the tool wall in order to fracture a frangible locking ring. The required flexing that must take place in the wall is difficult to calculate and predict when designing the tool and the locking ring.

Other problems associated with current downhole tools are related to space. A liner hanger with its slips and cones necessarily requires a certain amount of space as it is run-into the well. This space requirement makes it difficult to insert a liner hanger through previously installed tools like mechanical packers because the inside diameter of the previously installed tool is reduced. Space problems also arise after a slip and cone tool is set in a well because adequate clearance must be available for the subsequent flow of liquids like cement through the annular area between the tubulars.

Technology is emerging for selectively expanding the diameter of tubing or casing in a well. FIG. 1 depicts an expansion apparatus 100 which can be lowered into a well to a predetermined location and can subsequently be used to expand the diameter of the tubular member. The apparatus 100 comprises a body having two spaced-apart, double conical portions 102*a, b* with rollers 105 mounted therebetween. The rollers 105 may be urged outwards by application of fluid pressure to the body interior via the running string 103. Fluid pressure in the running string urges the conical portions 102*a, b* towards each other and forces the rollers 105 into contact with a wall 107 of a tubular member 110 sufficient to deform the wall of the tubing. Each roller 105 defines a circumferential rib 115 which provides a high pressure contact area. Following the creation of an expanded area 120 visible in FIG. 2, the fluid pressure in communication with the apparatus is let off, allowing the rollers 105 to retract. The apparatus 100 is then moved axially a predetermined distance to be re-energized and form another expanded area or is removed from the well. In the embodiment shown in FIGS. 1 and 2, the portions contacting the tube wall are rollers. However, the portions contacting the tubular wall could be non-rotating or could rotate in a longitudinal direction allowing the creation of a continued area of expansion within a tubular body.

There is a need therefore, for a slip and cone tool which requires less space as it is inserted into the well.

There is a further need for a slip and cone tool that requires less space after it has been set in the well.

There is a further need for downhole tools that utilize a removable expansion apparatus for activation.

There is a further need for a method of expanding a tubular wall in a well when the portion of the tubular to be expanded is located below a previously set, non collapsible tool.

There is a farther need for a downhole tool that can be operated or set in a wellbore by simple, remote means.

There is a further need for a downhole tool that can be operated or actuated without the use of chambers.

There is a further need for a downhole tool that can be operated without the use of gravity feed balls or other objects dropped from the earth's surface.

SUMMARY OF THE INVENTION

The invention relates to methods, apparatus and tools to be used with tubular expansion apparatus. In one aspect of the invention, tools are actuated or operated within a well by selectively expanding the tool wall. More specifically, a tool, like a casing liner hanger is provided with a chamber formed on the exterior surface of the tool creating a pressure differential within the tool. A locking ring around the outside of the tool body normally locks the piston in place. To actuate the tool, the tool wall is urged outward past its elastic limits. The expanding wall physically unlocks a locking ring which then unlocks the piston. Thereafter, hydraulic pressure differences are employed to move the piston to operate the downhole tool. In another aspect of the invention, a tool includes a cone formed thereupon and a multi-part slip disposed around the tool body. To operate the tool, the body is expanded at a first end of the slip and then expanded in an axial direction towards the cone. In this manner, the slip is forced onto the cone by the expanding body and the tool thereby set against the casing wall. In another aspect of the invention, a body is formed with a cone having teeth thereupon. To set the tool, the body of the tool is expanded directly under the toothed cone so as to force the teeth of the cone into contact with the casing wall to set the tool. In yet another aspect of the invention, a first piece of casing is joined to a second, larger diameter casing. By expanding the diameter of the first piece of casing into contact with the second piece of casing, the two are joined together. The joint is formed with helical formations in a manner that provides flow paths around the intersection of the two members for the passage of cement or other fluid.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 3:
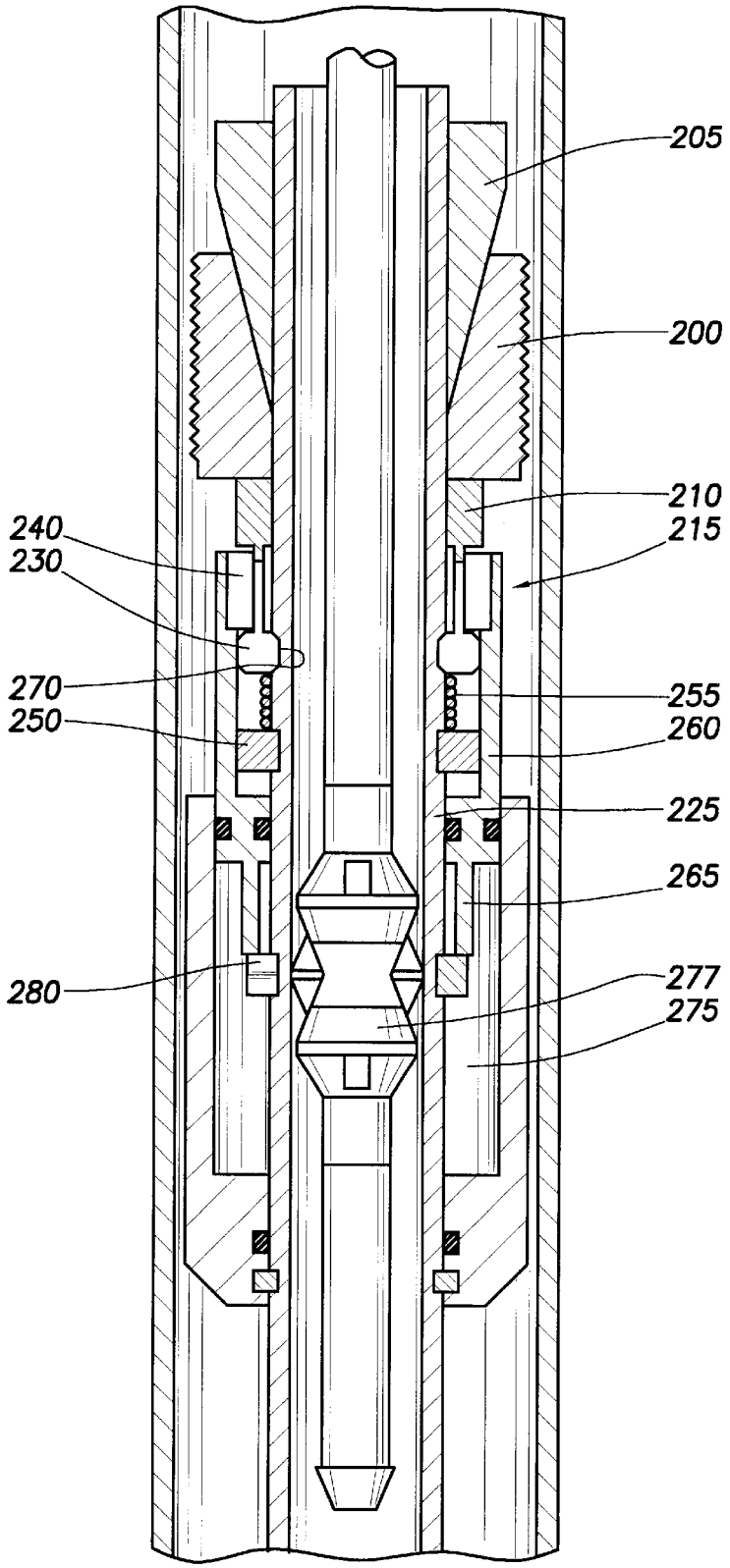
FIG. 3 is a section view showing an unactuated tool of the present invention.
Figure 3A:
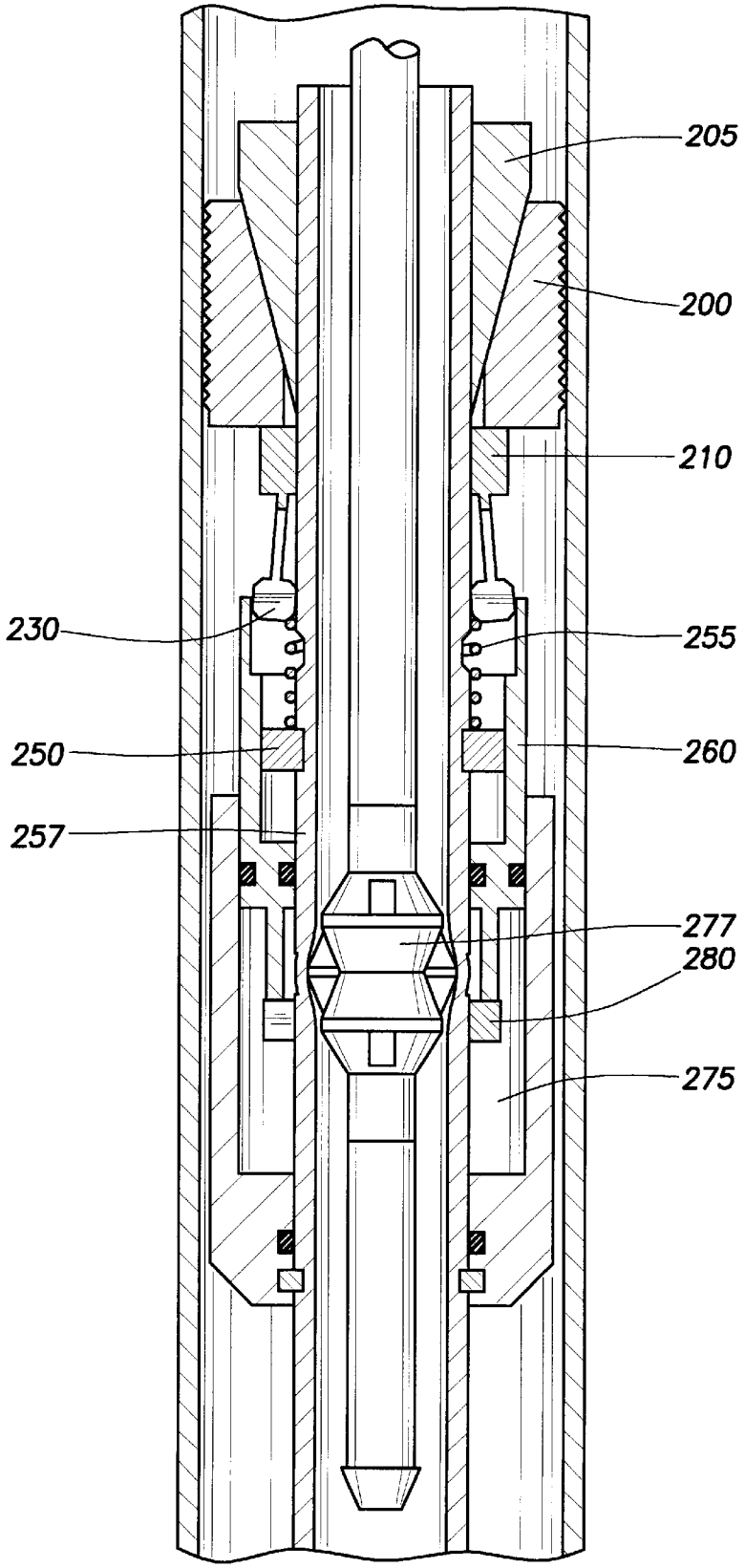
FIG. 3*a* is a section view showing the tool of FIG. 3 in an actuated state.

A first embodiment of the invention is shown if FIG. 3. For illustrative purposes, the tool is shown in use with a casing lining hanger. However, those skilled in the art will appreciate that the tool described and claimed herein can be used to perform any number of tasks in a well wherein simple, reliable and remote actuation or operation is required. The casing line hanger in FIG. 3 includes a mechanism for setting a number of slips 200 by pushing them along a cone 205. In the run-in position shown in FIG. 3, the slips 200 are retracted to facilitate the insertion of the downhole tool in the wellbore. Ultimately, as can be seen by comparing FIGS. 3, and 3A the slips 200 will be driven up the sloping surface of cone 205. The slips 200 are held by a retainer 210, which in turn abuts a piston assembly 215. Piston assembly 215 includes a piston 260, a lug 230, which in the run-in position is trapped in groove 270 by sleeve 240. Sleeve 240 abuts lug 230 on one end, while the other end of lug 230 is in groove 270, thus effectively trapping the piston assembly 215 from longitudinal movement. A support ring 250 is secured to the wall 255 of the tool. The support ring 250 supports a spring 255, which, when the lug 230 is liberated by movement of sleeve 240, results in biasing the piston 260 in a manner which will drive the slips 200 up the cone 205, as shown in FIG. 3A.

Piston assembly 215 has an extending segment 265 which extends into an atmospheric chamber 275. The pressure in chamber 275 is preferably atmospheric, but can be a different pressure up to near the annulus pressure. Because the hydrostatic pressure acting on piston assembly 215 in the wellbore exceeds the opposing pressure exerted on extending segment 265 within cavity 275, piston assembly 215 tends to want to move downward against lock ring 280.

Figure 1:
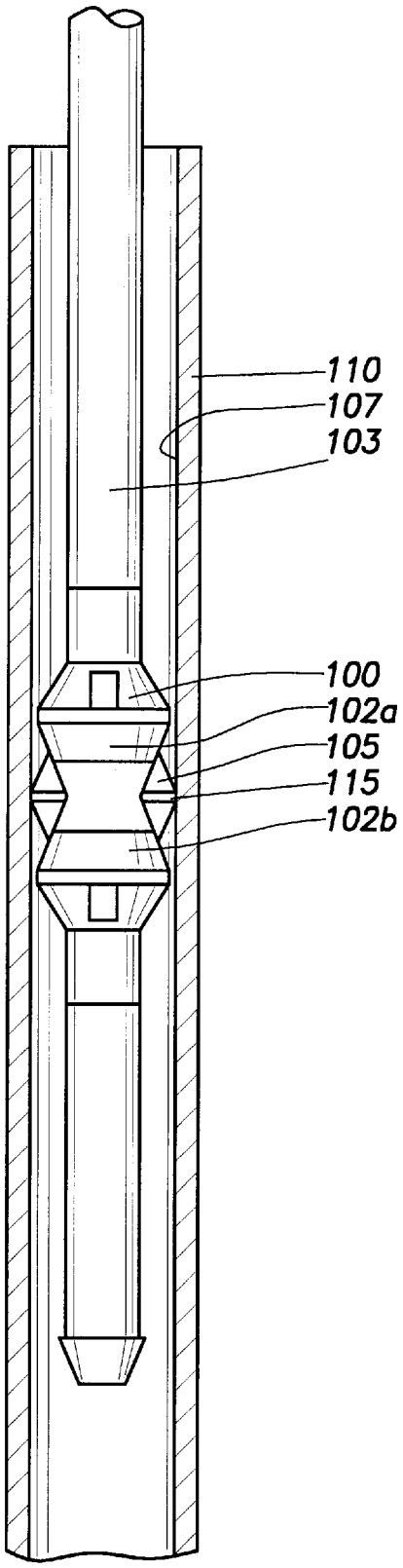
FIG. 1 is a is a section view showing an expansion apparatus in an actuated state.
Figure 2:
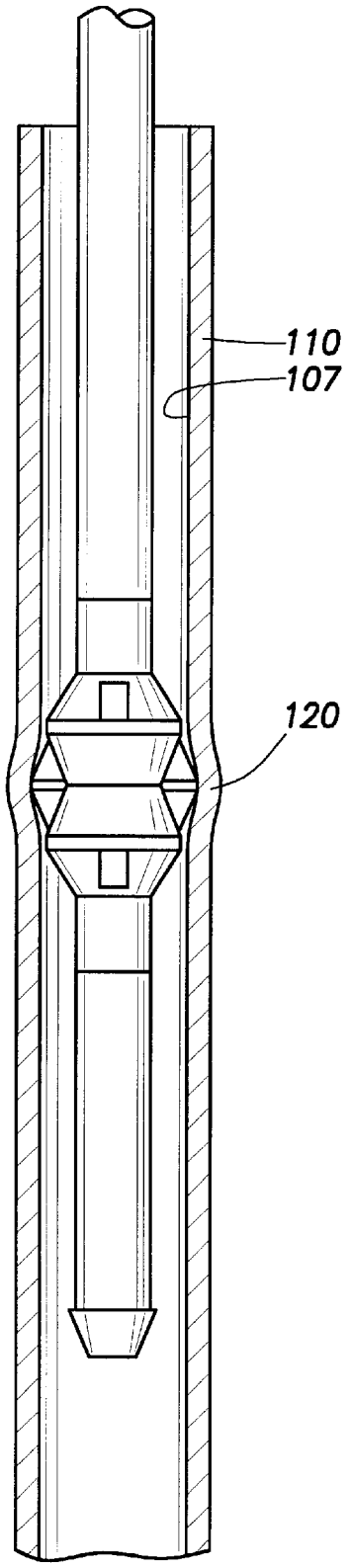
FIG. 2 is a is a section view showing an expansion apparatus.

In the preferred embodiment, the locking ring is broken when the wall of the tool is expanded by a radial force transmitted from inside the wall. This expansion of the tool wall by an apparatus like the mechanism shown in FIGS. 1 and 2 puts an increasing stress on lock ring 280, causing the lock ring, which can be preferably of a ceramic material, to break. Since the piston assembly 215 is in a pressure imbalance and the pressure internally in chamber 275 is significantly lower than the hydrostatic pressure in the annulus outside the tool, the piston assembly 215 shifts further into the chamber 275, as illustrated in FIG. 3A. Once sufficient movement into chamber 275 has resulted in a liberation of lug 230, spring 255 moves the piston assembly 215 upwardly, thus camming the slips 200 up the cone 205.

Figure 4:
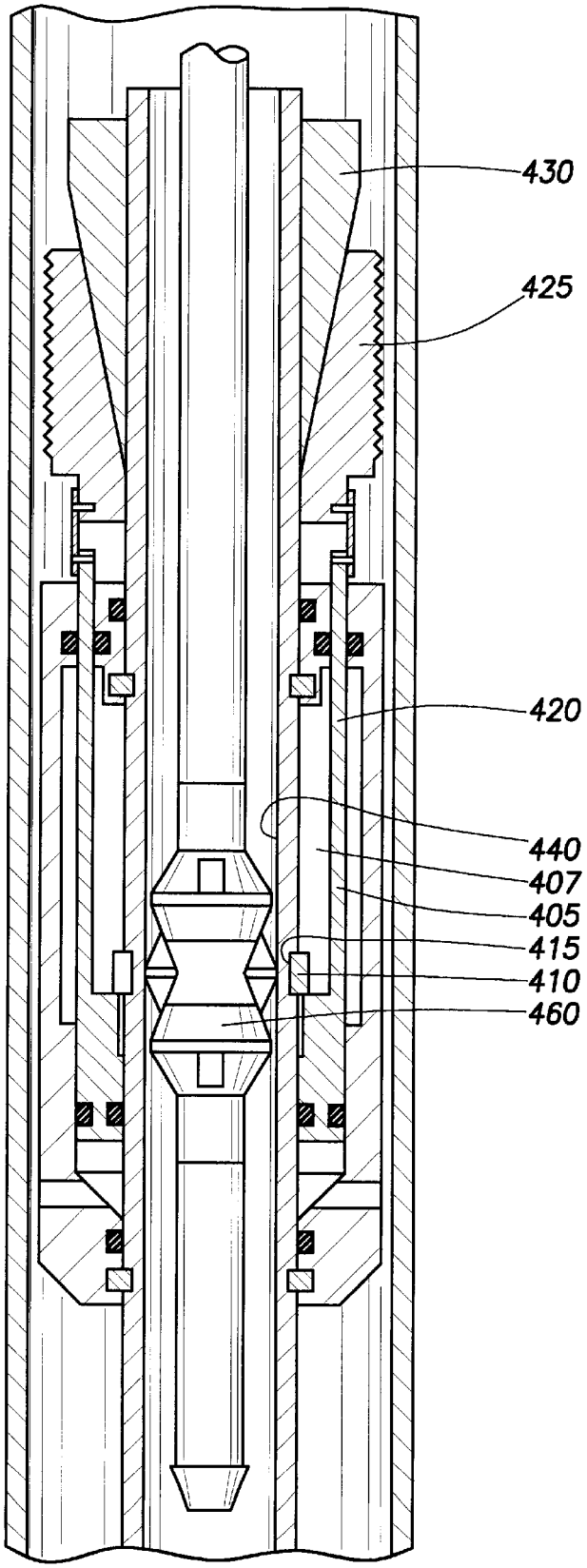
FIG. 4 is a section view showing another embodiment of the present invention.

In a second embodiment of the invention, the atmospheric chamber in the tool is formed in such a way as to make the spring loaded function of the tool unnecessary. FIG. 4 depicts the second embodiment in its unset or run-in position. A piston 405 is held in a locked position within a chamber 407 by a locking ring 410 that is seated in a groove 415. Unlike the previous embodiment, the piston is arranged in such a way that when actuation of the tool is initiated by breaking the locking ring 410 and allowing the piston 405 to travel in response to the pressure differential, an arm 420 formed at the end of the piston 405 directly contacts the slip 425 and forces the slip upon the cone 430, thereby setting the tool. The embodiment herein described avoids the use of a spring loaded mechanism, saving parts and expense and complexity. As in the embodiment of FIGS. 3 and 3A, the locking ring is fractured by a radial force applied to the interior wall 440 of the tool by an expansion apparatus 460.

Figure 5:
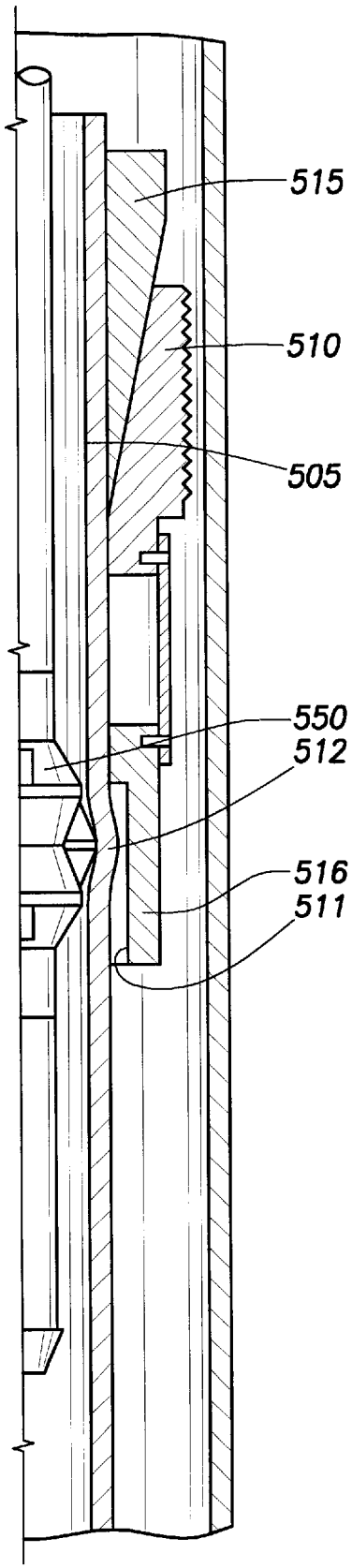
FIG. 5 is a section view showing another embodiment of the present invention.
Figure 5A:
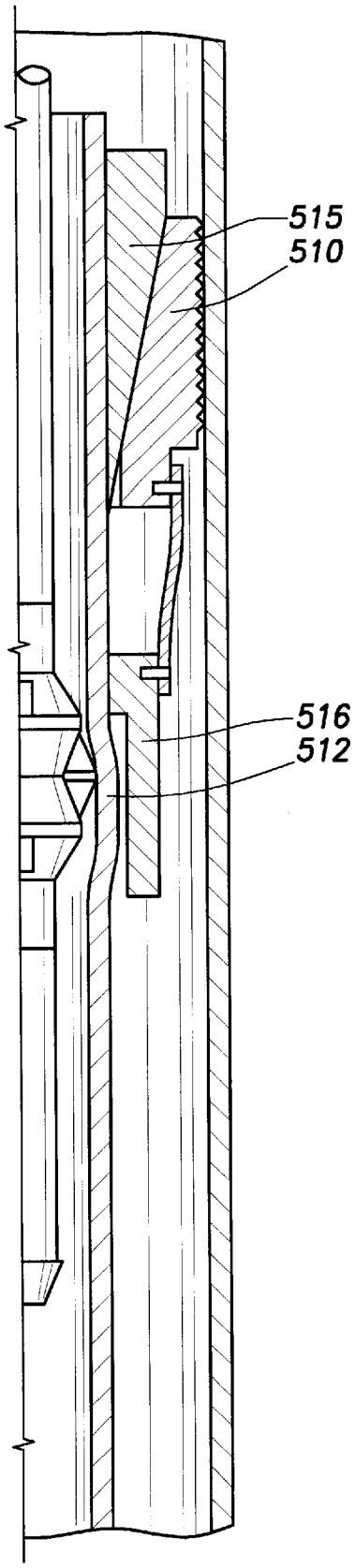
FIG. 5*a* is a section view showing the tool of FIG. 5 in an actuated position.

Another embodiment of the invention is shown in FIGS. 5 and 5A. In this embodiment, the tool consists of a body 505, a multi-piece slip 510 disposed around the body and attached to a ring 516 and a cone 515 mounted on the outer surface of the body. The slip assembly 510 includes toothed members constructed and arranged to contact the wall of the casing when the tool is set. In this embodiment, the tool also includes a slight undulation or profile 512 in the tool body under a cut-out portion 511 of ring 516. The profile 512, in the preferred embodiment, is formed in the tool wall at the surface of the well and houses a roller of the expansion apparatus 550 in a partially energized state. By pre-forming the profile 512, the apparatus 550 is located at the correct location with respect to the tool body and the profile 512 additionally retains the tool in the unset or run-in position.

In order to operate the tool of this embodiment, the expansion apparatus 550 is energized at the location of the profile. Thereafter, the expansion apparatus is urged upwards while energized. The apparatus may also be rotated while it is being urged upwards. As the tool is pulled, the profile 512 assumes the shape shown in FIG. 5A as it is axially extended in the direction of the cone 515. In this manner the slips 510 are urged onto the cone thereby pressing the toothed portion of the slip against the casing wall to set the hanger. When the slip has moved far enough onto the cone for the hanger to be securely set, the expansion tool is de-energized and removed from the well bore.

Figure 6:
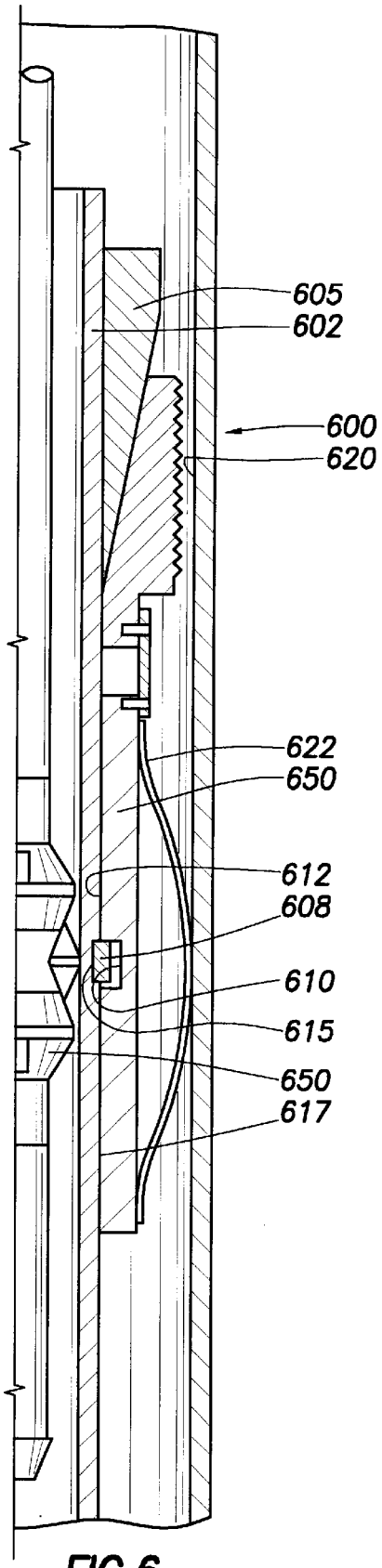
FIG. 6 is a section view showing another embodiment of the present invention.

In another embodiment depicted in FIG. 6, a liner hanger 600 includes a body 602 and a cone 605 formed thereupon. Disposed around the body is a ring 650 having a groove 610 formed in its inner surface 612 which aligns with a groove 615 formed on the outer surface 617 of the body 602. A locking ring 608 held in the grooves 610, 615 prevents the ring 650 from moving in relation to the body. The ring 650 is further suspended within the wall of casing 620 by means of at least two leaf springs 622 mounted on the outer surface of the ring 650. In this embodiment, when the lock ring 608 is broken due to expansion of the tool body by an expansion apparatus 650, the frictional relationship between the ring 650 and the casing wall 620 causes the ring 650 to remain stationary in the wellbore The liner is thereafter set when the tubing string and tool body 602 is pulled upwards and the slip is driven onto the cone.

Figure 7:
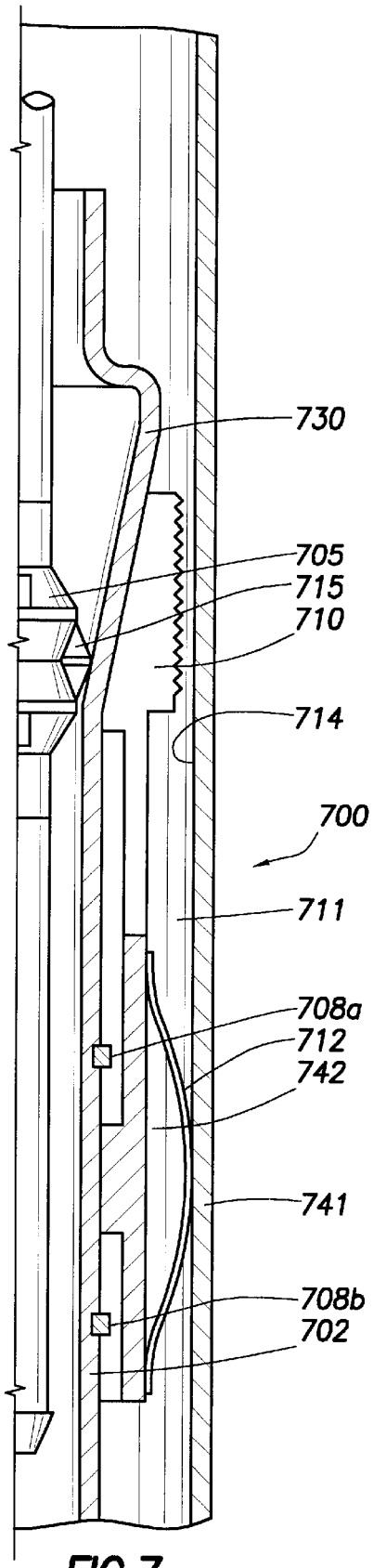
FIG. 7 is a section view showing another embodiment of the present invention.
Figure 8:
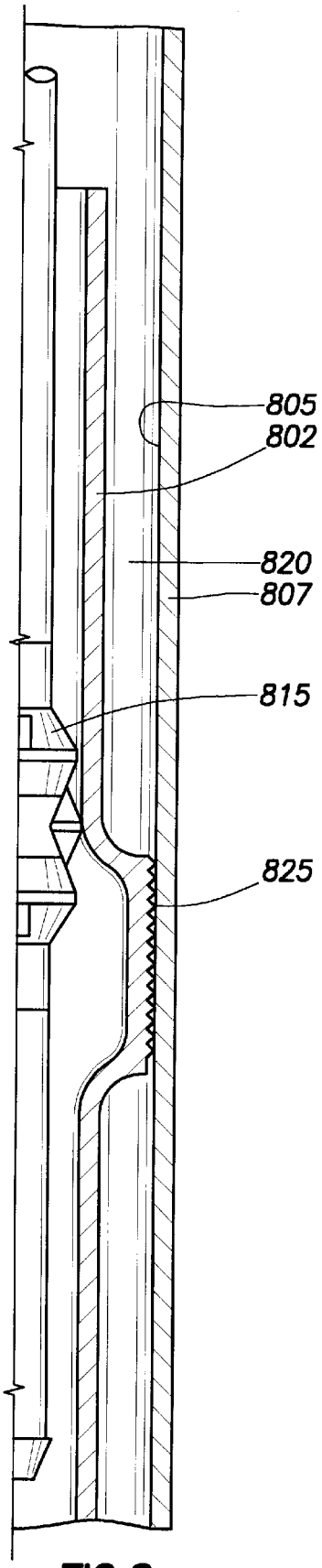
FIG. 8 is a section view showing yet another embodiment of the present invention.

In yet another embodiment of the invention illustrated in FIG. 7, a slip actuated gripping device like a liner hanger 700 for example, is provided having a body 702 without a cone initially formed thereon. In this embodiment, a cone for setting the slip is formed in the wellbore using an expansion apparatus with the capability of expanding a tubular to various, gradually increasing diameters. In the preferred embodiment, slip assembly 710 consisting of a ring and slips is disposed around body 702 and retained during run-in by two rings 708*a, b*. Slip assembly 710 is also suspended within annulus 711 by at least two leaf springs 712 in frictional relation with the inner wall 714 of tubular member 741 and the outer surface 742 of slip assembly 710. The expansion apparatus 705 is then energized at a predetermined location opposite the slip assembly 710. As the apparatus 705 is moved upwards in the well and rotated, the rollers 715 extend outwards in a gradually increasing manner, thereby forming a cone 730 that is slanted in the direction of the slip assembly 710. After the expansion apparatus 705 is de-energized and removed, the liner hanger 700 is set by lowering the body 702 in relation to the stationary slip assembly 710. Due to the absence of a cone formed on the liner hanger at the time of run-in, the tool of this embodiment has a reduced outer diameter and may be passed through a smaller annular area than prior art liners having a cone. While in the preferred embodiment the cone is formed in the direction of the well surface, it will be understood that the formation of a continuous expanded diameter can be made in any direction In yet another embodiment of the invention depicted in FIG. 8, a first smaller diameter tubular 802 is expanded directly into engagement with the inner surface 805 of a larger diameter tubular 807. In this embodiment, the expansion apparatus includes a roller capable of extending the wall of the first tubular 802 the entire width of the annular area 820 between the two tubulars 802, 807. In the preferred embodiment, that portion of smaller diameter tubular 802 to be expanded into contact with the outer tubular, includes teeth 825 formed thereupon or some other means to increase grip between surfaces.

Figure 9:
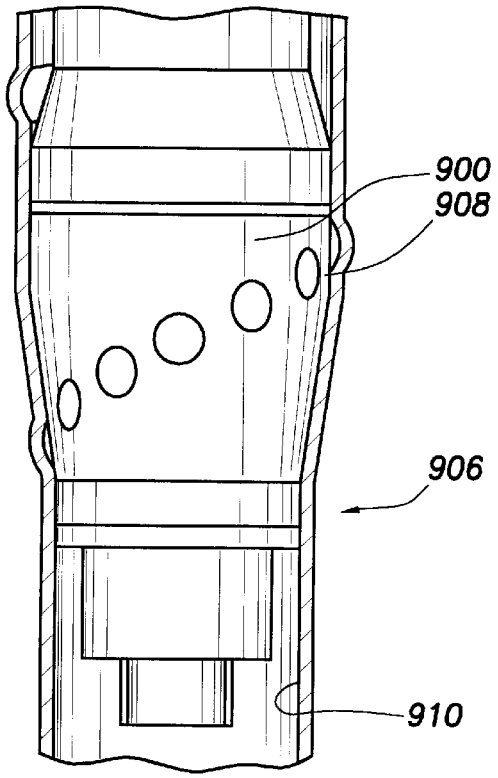
FIG. 9 is a section view showing an expansion apparatus.
Figure 10:
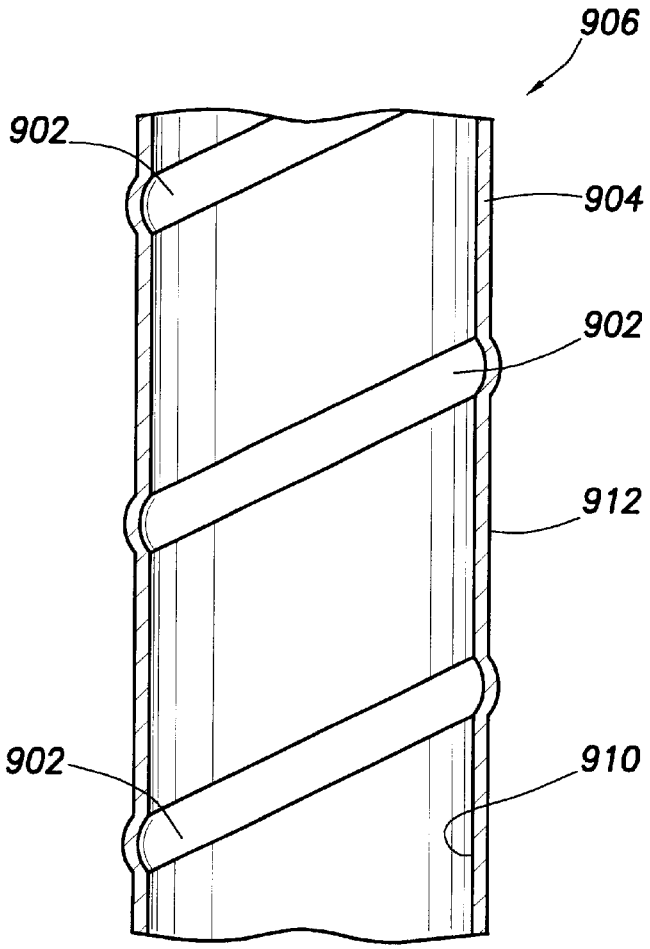
FIG. 10 is a view showing tubing with a helical formation formed therein.

In another embodiment of the invention shown in FIGS. 9 and 10, a series of helical grooves 902 are formed in a wall 904 of a tubular member 906 through the use of an expanding member having rollers mounted in a helical fashion as shown in FIG. 9. Specifically, the expansion apparatus 900 includes expandable rollers 908 that extend around the circumference thereof in a helix. The rollers 908 are constructed and arranged to extend outward as the apparatus is energized so as to come into contact with and exert a radial force upon the inside wall 910 of a tubular member 906. As the expansion apparatus 900 is rotated and moved in an axial direction, a helical formation is left on the inner 910 and outer 912 walls of the tubular member 906. This embodiment is particularly advantageous for making a connection between two pieces of casing in a manner that provides channels for the subsequent flow of drilling fluid or cement. The angle and depth of the helical grooves is variable depending upon well conditions and will be determined somewhat by the size of the annular area between two pieces of tubing to be joined together. In the embodiment described, rollers are used as the point of contact between the expansion apparatus and the tubular wall. However, the shape and configuration of the expansion apparatus members contacting and exerting a radial force upon the wall of tubulars in this and any other embodiment herein are not limited.

Figure 11:
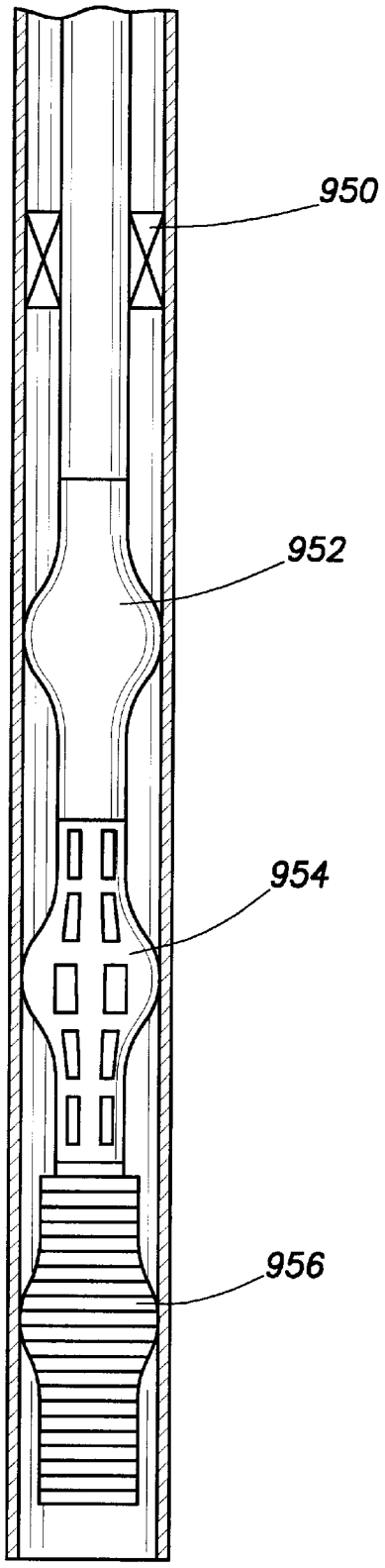
FIG. 11 is a section view showing various lengths of tubing having been expanded.

FIG. 11 demonstrates yet another method of expanding a tubular downhole. A non-collapsible mechanical packer 950 is located at a first location in the well and below that packer are various strings of tubulars including solid tubing 952, slotted liner 954 and sand screen 956. An expansion apparatus may be inserted into the well through the reduced diameter of the mechanical packer 950 and the various tubulars may then be selectively expanded. Thereafter, the apparatus can then be removed from the well without damaging the mechanical packer.

While the foregoing is directed to the preferred embodiment of the present invention, other and further embodiments of the invention may be devised without departing from the basis scope thereof, and the scope thereof is determined by the claims that follow.

What is claimed:

1. A tool for performing a downhole operation, comprising:

a tubular body forming a wall, the wall having an interior which defines a passage therein and an exterior which, when placed in the wellbore, defines an annular space therewith;

an actuating member movably mounted on the outside of the wall for performing the downhole operation; and a locking member mounted on the outside of the wall to selectively prevent motion of said actuating member until said locking member is unlocked responsive to expansion of the wall of the tubular body.

2. The tool of claim 1, whereby the actuating member is a spring.

3. The tool of claim 1, whereby the actuating member includes a piston and an atmospheric chamber.

4. The tool of claim 1, wherein the locking member is broken due to the expansion of the wall.

5. The tool of claim 1, wherein the locking member comprises a ceramic material.

6. An apparatus for performing a downhole operation from the surface of a well, comprising:

a tubular body forming a wall, said wall having an interior which defines a passage therein and an exterior which, when placed in the wellbore, defines an annular space therewith;

a ring member disposed around the body, the ring member includes a plurality of slips and is held in frictional contact with an inner surface of an outer casing by a spring; and a locking member mounted to the wall of the tool to selectively prevent motion of said ring until said locking member is unlocked responsive to expansion of the wall of the tubular body.

7. The apparatus of claim 6, whereby the apparatus is set by lowering the body in relation to the ring and slips after the tool is unlocked.

8. The apparatus of claim 6, wherein the spring is a leaf spring.

9. An apparatus for performing a downhole operation from the surface of a well, comprising:

a tubular body forming a wall, said wall having an interior which defines a passage therein and an exterior which, when placed in the wellbore, defines an annular space therewith;

a cone formed on the outside surface of the body;

a ring member disposed about the body;

at least one slip disposed around the body;

a groove formed on an inner surface of the ring; and an outwardly extending profile disposed about the wall of the body and within the groove, wherein the tool is set by expanding the profile through a radial force applied to the wall in the direction of the cone, thereby forcing the slip onto the cone.

10. An apparatus for performing a downhole operation from the surface of a well, comprising:

a tubular body forming a wall, said wall having an interior which defines a passage therein and an exterior which, when placed in the wellbore, defines an annular space therewith;

a ring member disposed around the body, the ring member having a plurality of slips and held in frictional contact with an inner surface of an outer casing by a spring;

a locking member mounted to the wall of the tool to selectively prevent motion of said ring until said locking member is unlocked responsive to expansion of the wall of the tubular body;

means for expanding the wall of the tubular body to unlock the tool and form a cone shape in the wall, wherein the cone shape is formed to receive the slips.

11. An apparatus for performing a downhole operation from the surface, comprising:

a tubular body forming a wall, said wall having an interior which defines a passage therein and an exterior which, when placed in the wellbore, defines an annular space therewith; and at least one surface of the outer surface of the body having a grip enhancing material attached thereto, whereby the tool is actuated when the wall of the tool is expanded into contact with the inside surface of another, larger diameter tubular member.

12. A method of changing the state of a down hole tool in a well comprising the steps of:

providing a tool at a predetermined location in a well, wherein the tool comprises:

a tubular body with a cone formed thereon, a ring disposed around the body with a plurality of slips extending therefrom, a setting mechanism to urge the slips up the cone and a locking mechanism on the body of the tool to prevent premature setting of the tool;

placing a n expansion apparatus in the body of the tool, the expansion apparatus including at least one energizable member capable of placing a radial force upon the inside wall of the tool body; and energizing the member at a location in the tool opposite the locking mechanism, thereby causing the setting mechanism to urge the slips up the cone.

13. The method of claim 12, wherein the energized member indirectly causes the setting mechanism to urge the slips up the cone.

14. The method of claim 12, wherein the expansion apparatus comprises a plurality of rollers.

15. The method of claim 12, wherein the expansion apparatus comprises a plurality of rollers having a helical geometry.

16. The method of claim 12, further comprising rotating and advancing the tool within the well.

17. The method of claim 12, further comprising moving the expansion member axially within the body of the tool, thereby creating a lengthened expanded diameter portion of the tool.

18. A method of changing the state of a tool in a well, comprising the steps of:

providing a tool in a first state having:

a body, a state-changing mechanism, a locking mechanism to keep the tool in the first state;

providing an expansion apparatus with an expansion mechanism within the tool; and energizing the expansion mechanism of the expansion apparatus thereby exerting a radial force on the body of the tool and unlocking the locking mechanism, and thereby causing the tool to advance to a second state.

19. The method of claim 18, wherein the expansion apparatus comprises a plurality of rollers.

20. The method of claim 18, wherein the expansion apparatus comprises a plurality of rollers having a helical geometry.

21. The method of claim 18, further comprising rotating and advancing the tool within the well.

22. The method of claim 18, further comprising moving the expansion member axially within the tool, thereby creating a lengthened expanded diameter portion of the tool.

* * * * *